United States Patent [19]

Shackleton

[11] Patent Number: 4,586,294

[45] Date of Patent: May 6, 1986

[54] MACHINE TOOLS

[75] Inventor: Raymond T. Shackleton, Crossroads, England

[73] Assignee: Keighley Grinders (Machine Tools) Limited, Keighley, England

[21] Appl. No.: 705,417

[22] Filed: Feb. 27, 1985

Related U.S. Application Data

[63] Continuation of Ser. No. 661,890, Oct. 18, 1984, abandoned, which is a continuation of Ser. No. 473,677, Mar. 8, 1983, abandoned, which is a continuation-in-part of Ser. No. 179,756, Aug. 20, 1980, Pat. No. 4,376,357.

[30] Foreign Application Priority Data

May 21, 1980 [GB] United Kingdom ..... 8106766

[51] Int. Cl.[4] ..... B24B 19/14

[52] U.S. Cl. ..... 51/105 SP; 51/5 D; 51/106 R; 51/165.75; 51/240 A; 409/191; 409/211

[58] Field of Search ..... 51/4, 5 R, 5 D, 47, 51/98.5, 99, 101 R, 103 C, 105 SP, 105 R, 106 R, 106 LG, 106 VG, 124 R, 124 L, 125.5, 126, 147, 165.75, 165.87, 165.88, 166 MA, 216 A, 217 A, 218 A, 240 A, 262 R, 277, DIG. 15; 409/191, 200, 201, 211

[56] References Cited

U.S. PATENT DOCUMENTS

| | | | |
|---|---|---|---|
| 2,132,924 | 10/1938 | Belden | 51/240 A |
| 2,159,106 | 5/1939 | Richter | 51/5 R X |
| 2,410,348 | 10/1946 | Johanson et al. | 51/101 R |
| 2,455,762 | 12/1948 | Hall | 51/5 R |
| 2,611,221 | 9/1952 | Rhodes | 51/165.75 X |
| 2,654,189 | 10/1953 | Dunn et al. | 51/101 R |
| 2,787,089 | 4/1957 | Hawkinson | 51/106 R X |
| 2,911,764 | 11/1959 | Steggeman | 51/106 R |
| 3,482,357 | 12/1969 | Inaba et al. | 51/101 R |
| 3,815,288 | 6/1974 | Wilson | 51/101 R X |
| 4,122,634 | 10/1978 | Nishimura et al. | 51/101 R X |
| 4,376,357 | 3/1983 | Shackleton | 51/5 D X |

FOREIGN PATENT DOCUMENTS

| | | | |
|---|---|---|---|
| 925721 | 9/1947 | France | 51/165.75 |
| 974267 | 11/1964 | United Kingdom | 51/165.75 |

*Primary Examiner*—Robert P. Olzewski

*Attorney, Agent, or Firm*—Watson, Cole, Grindle & Watson

[57] ABSTRACT

A grinding machine in which a workpiece, to have grinding operations carried out at different locations along the workpiece at different radii and at different angles, is mounted between centers on a slideway to present the locations on the workpiece to a motor driven grinding wheel mounted in a grinding head. The grinding head is mounted on a slideway to traverse the grinding wheel towards and away from the periphery of the workpiece. The grinding wheel is mounted on the slide for rotational adjustment about an axis extending tangential to the periphery of the grinding wheel at a location where the grinding wheel acts on the workpiece for adjustment of the angle of cut of the grinding wheel. Since the grinding wheel turns about an axis when its angle is adjusted, the position of an angle of cut is not otherwise varied by the angular adjustment of the grinding wheel. A control mechanism is provided for enabling the grinding wheel to be accurately preset to a number of predetermined angles to suit the workpiece to be ground. The grinding wheel head includes a dresser unit for dressing the grinding wheel and a mechanism for moving the dressing unit into engagement with the grinding wheel to dress the wheel and for restoring the grinding wheel with compensation for the amount of material removed by the dresser unit from the periphery of the grinding wheel.

45 Claims, 9 Drawing Figures

43
19
1
2
3
4
5
6
7
8
18
RADIUS 51
52
53
54
55
56
57
58
59
60
61
62
63
64
65
69
70
73

73
74
75
76
78
79
80
80a
81
82
83

73
77

MACHINE TOOLS

This application is a continuation of application Ser. No. 661,890, now abandoned, filed Oct. 18, 1984 as a continuation of application Ser. No. 473,677, now abandoned, filed Mar. 8, 1983 as a continuation-in-part of application Ser. No. 179,756, now U.S. Pat. No. 4,376,357 filed Aug. 20, 1980.

BACKGROUND OF THE INVENTION

1. Field of the Invention

This invention relates to machine tools and is particularly although not exclusively applicable to grinding machines including grinding machines for grinding the blade tips of multi-stage turbine or compressor rotors.

2. Description of the Prior Art

Machine tools are commonly known in which a workpiece rotates about a fixed axis and a rotary tool having a peripheral cutting face is traversed towards and away from the workpiece surface to carry out a cutting operation on the workpiece surface. In order to adjust the angle of cut with respect to the workpiece axis, the rotary cutting tool has a mounting which permits rotational adjustment of the tool to provide the required angle of cut. Such an arrangement requires considerable setting time in order to set the angle of cut correctly with the location of cut at the correct station on the workpiece since adjusting the angle of cut disturbs other adjustments of the tool.

In the case of blade tip grinding, the radius of the blade tips are given with reference to a longitudinal dimension from a datum. On a normal "Universal" grinding machine the pivot axis, about which the grinding wheelhead is pivoted for the various angles, is remote from the periphery of the grinding wheel. This necessitates angular adjustment to a much higher accuracy, than that required by the actual component, in order to establish the correction required in both the radial and longitudinal axes for the various angles. In practice this precludes an automatically sequenced machine, as there is no positive method of checking the position of the grinding wheel periphery.

SUMMARY OF THE INVENTION

A machine tool comprising means to support and rotate a workpiece about a fixed first axis for an operation to be carried out on a peripheral part of the workpiece at a work station adjacent the workpiece, slide means for supporting the workpiece support means for movement of the workpiece in the direction of the fixed axis to present different locations along the workpiece for operation thereon at the work station, a rotary tool having a peripheral cutting face, a feed slide for the tool, means to feed the slide towards and away from the fixed axis for the tool to act on the workpiece, a tool carrier, means to mount the rotary tool on the tool carrier for rotation of the peripheral cutting face thereof, means to mount the tool carrier on the feed slide for rotational adjustment about a second axis lying tangential to a circle centered on the fixed axis, means to mount the tool for linear adjustment on the tool carrier towards and away from the second axis for bringing the peripheral cutting face of the tool tangential to the second axis whereby adjustment of the tool about the second axis does not otherwise displace the circumferential cutting face of the tool at a point where it engages the workpiece, and means to turn the tool carrier about the second axis to any one of a number of defined positions of adjustment to provide a number of differing angles of operation of the tool on the workpiece.

By this arrangement it is possible to program the vertical pivot axis according to the drawing dimensions of the required workpiece and to adjust the grinding wheel periphery to the required angles with the required accuracy.

DESCRIPTION OF THE PREFERRED EMBODIMENT

Figure 2:
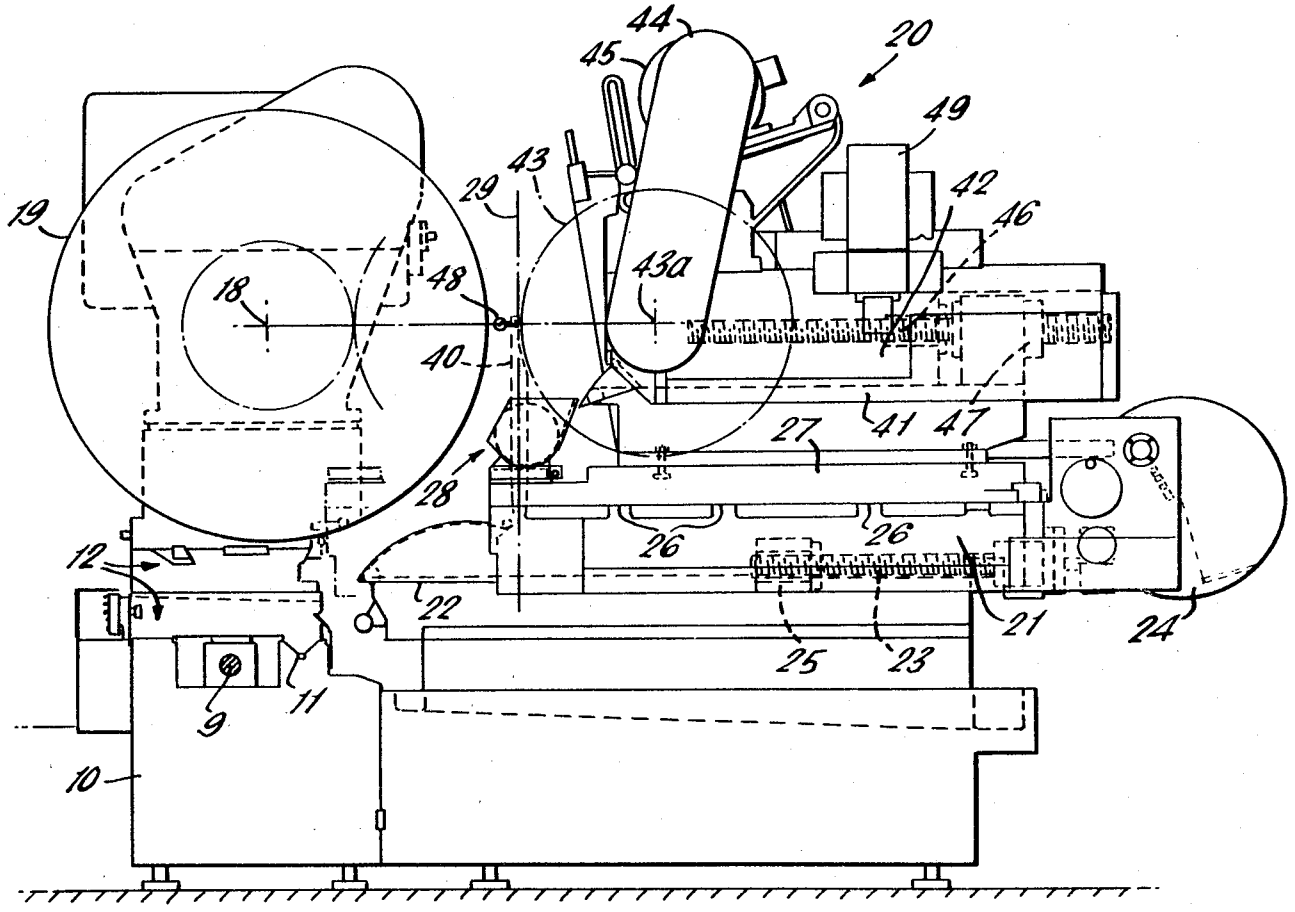
FIG. 2 is an end view of the grinding machine shown in FIG. 1.

The drawings show a grinding machine for grinding the tip blades of a multi-stage compressor or turbine rotor comprising a main base 10 formed with a slideway 11 extending along the length thereof on which a slide 12 is mounted to move. The slide 12 is displaced along the slideway 11 by means of a motor driven lead screw 9 as shown in FIG. 2. A control mechanism for moving the slide by predetermined amounts along the slideway will be described later.

The slide 12 carries a headstock 13 having a center 14 driven by a motor 15 and a tailstock 16 having a center 17. The centers 14, 17 are aligned along an axis indicated at 18. The centers support a multi-stage compressor or turbine rotor to rotate about the axis 18. The drawing illustrates seven rows of turbine blades of such a rotor. It will be seen that the rows of turbine blades decrease in diameter along the axis and that the ends 19*a* of the turbine blades 19 are differently angled from row to row. The purpose of the present grinding machine is the grinding of the correct blade tip angle to provide the appropriate clearance when the rotor is installed in its casing.

Figure 4:
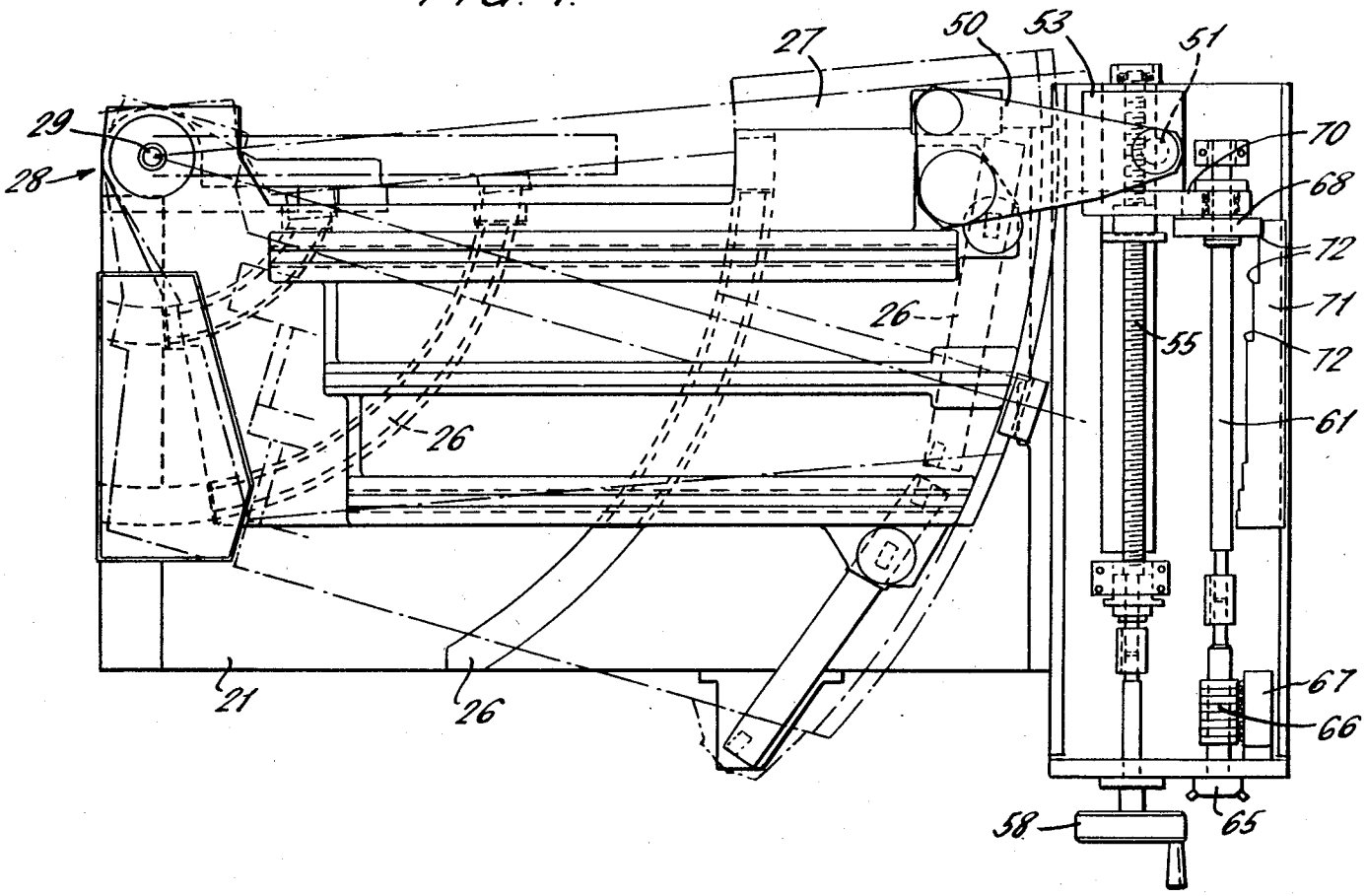
FIG. 4 is a diagrammatic view of part of the grinding head of the machine showing the mechanism for adjusting the angle of the grinding head.

Reference is now made to FIGS. 2 and 4 of the drawings which illustrate the grinding head of the grinding machine used to grind the ends of the turbines blades to the correct diameter and angle.

In FIGS. 2 and 4 of the drawings the grinding head indicated generally at 20 comprises a feed slide 21 mounted on a slideway 22 for movement of the grinding head towards and away from the axis 18 of the workpiece. The grinding head is driven along the slide by a lead screw 23 mounted in the slide and driven through gearing by a stepper motor 24. The lead screw engages in a bore nut 25 mounted on the base 10 adjacent the slideway 22.

The upper face of the slide 21 is formed with a number of spaced arcuate bearing surfaces 26 and a grinding wheel carrier 27 is mounted on the bearing surfaces 26 and a pivotal connection indicated generally at 28 is provided between the carrier 27 and the slide 21 at the ends thereof adjacent the workpiece axis so that the carrier 27 can turn about a vertical axis 29 with respect to the slide. The construction of the pivotal connection 28 is illustrated in greater detail in FIG. 8 to which reference will now be made. The slide 21 is formed with a step bore 30 in which a bearing hub 31 is mounted containing spaced preloaded bearing races 32. A hollow spindle 34 is supported in the preloaded bearing races and projects upwardly from the upper end of the hub 31 and is formed with a head 35. The head 35 engages in a bore 36 in the grinding wheel carrier 27, the latter being secured to the head by means of a clamping ring 38. The spindle 34 is formed with an upwardly open tapered socket 39 to receive the tapered end of the setting bar 40 the purpose of which will be described later.

Reverting again to FIG. 2 of the drawings, the carrier 27 is formed with an upwardly facing slideway 41 on which a slide 42 is mounted. A grinding wheel 43 is mounted along an axis at 43*a* on a spindle (not shown) supported in bearings on the slide 42 and is driven by a drive mechanism indicated at 44 from a drive motor 45. A stepper motor driven lead screw 46 is mounted on the slide 42 and engages in a bore nut 47 mounted on the slideway 41. Rotation of the lead screw thus draws the slide 42 in either direction along the slideway 41 thus moving the grinding wheel 43 towards and away from the axis 29.

Figure 8:
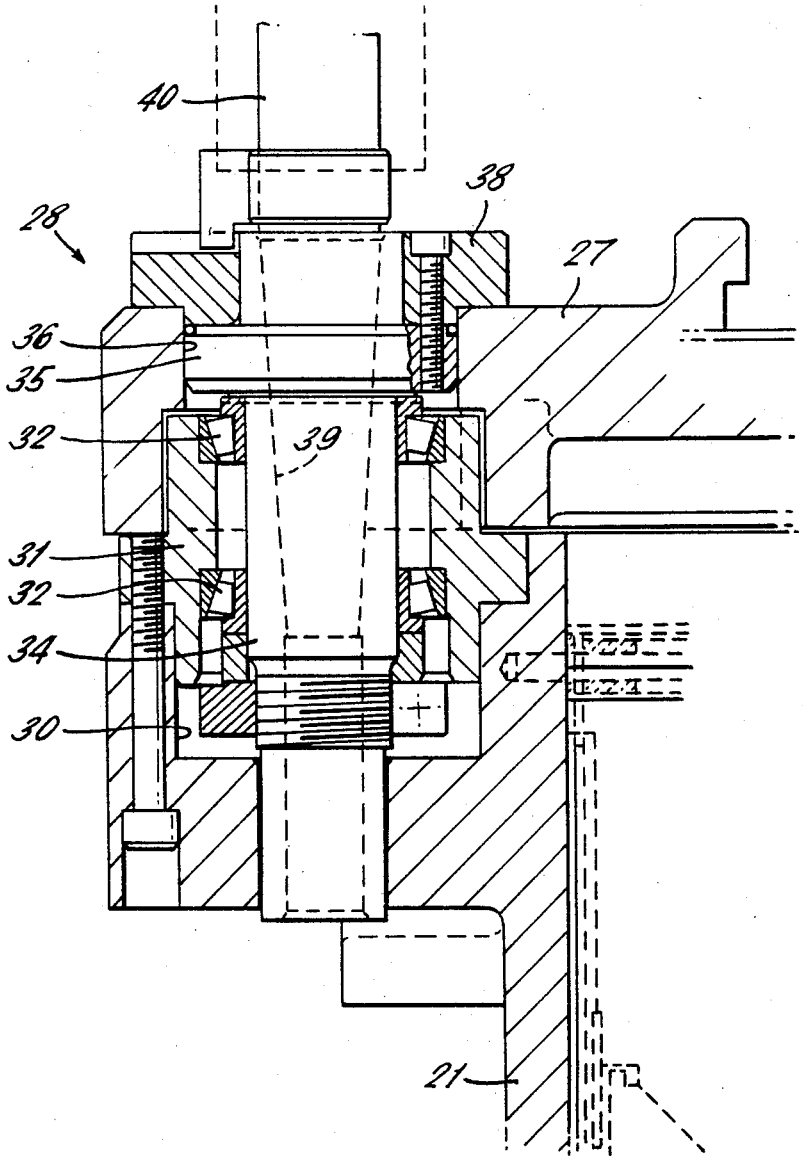
FIG. 8 is a section view through a pivot axis of the grinding head.

As can be further seen in FIG. 2 of the drawings, the axis of rotation of the grinding wheel 43 indicated at 43*a* is level with the workpiece axis 18. The position of the grinding wheel is such that the aforesaid vertical axis 29 extends tangentially to the periphery of the grinding wheel at the point on the grinding wheel nearest the workpiece axis 18. This tangent paint also lies on the horizontal line joining the axes 18 of the workpiece and 43*a* of the grinding wheel. The grinding wheel 43 is set up with its peripheral cutting face 43*b* coinciding with the axis 29 as described using the setting bar 40 located in the socket in the spindle 34 as illustrated in FIG. 8. The setting bar 40 carries a horizontally projecting dial gauge 48 at its upper end which acts along the horizontal line joining the axes 18 and 43*a*. The setting bar 40 is located with the proble of the dial gauge engaging the stationary grinding wheel periphery and the grinding wheel is adjusted by means of the lead screw 46 until the gauge reads zero indicating that the vertical axis 29 intercepts the periphery of the grinding wheel 43 tangentially. The setting bar 40 is then extracted from the spindle.

A diamond dresser unit 49 is mounted on the slide 42 for dressing the grinding wheel 43 as and when required during a grinding operation. For this purpose the dresser unit is moved along the slide by a motor driven lead screw (not shown). The unit is advanced by a predetermined increment to bring the diamond tool of the unit 49 into contact with the periphery of the grinding wheel. The grinding wheel is dressed parallel by the dresser and the amount of material removed from the periphery of the grinding wheel is monitored and the lead screw 46 is turned by its drive motor by a corresponding amount to return the grinding wheel to a position in which the vertical axis 29 intercepts the periphery of the grinding wheel vertically as shown in FIG. 2. Thus the removal of the worn grinding wheel surface whenever the grinding wheel is re-dressed is always compensated for so that the axis 29 always extends tangentially to the grinding wheel periphery whenever the grinding wheel is in use.

Figure 1:
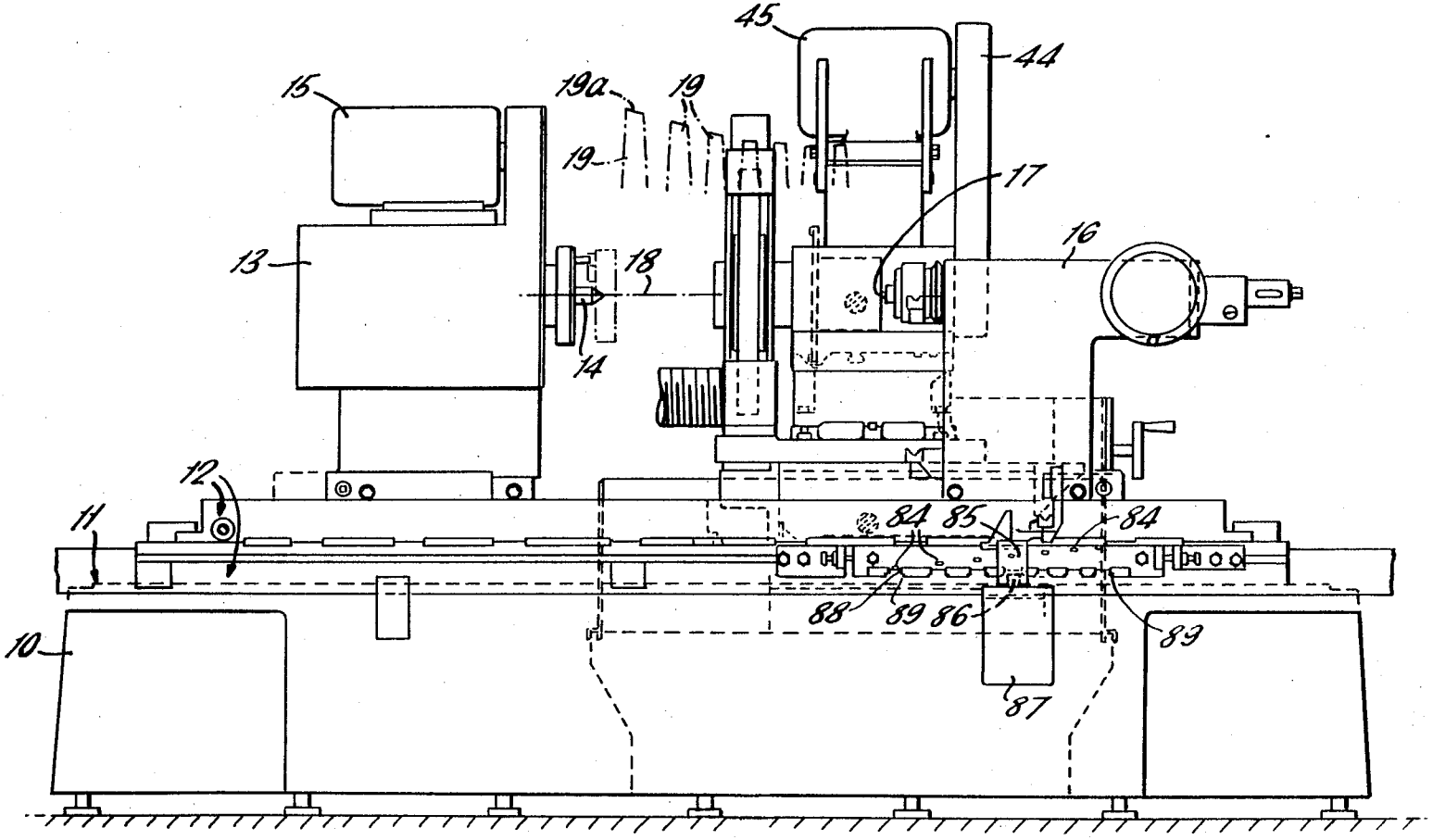
FIG. 1 is a front elevation view of a grinding machine for grinding the blade tips of multi-stage compressor or turbine rotors.
Figure 3:
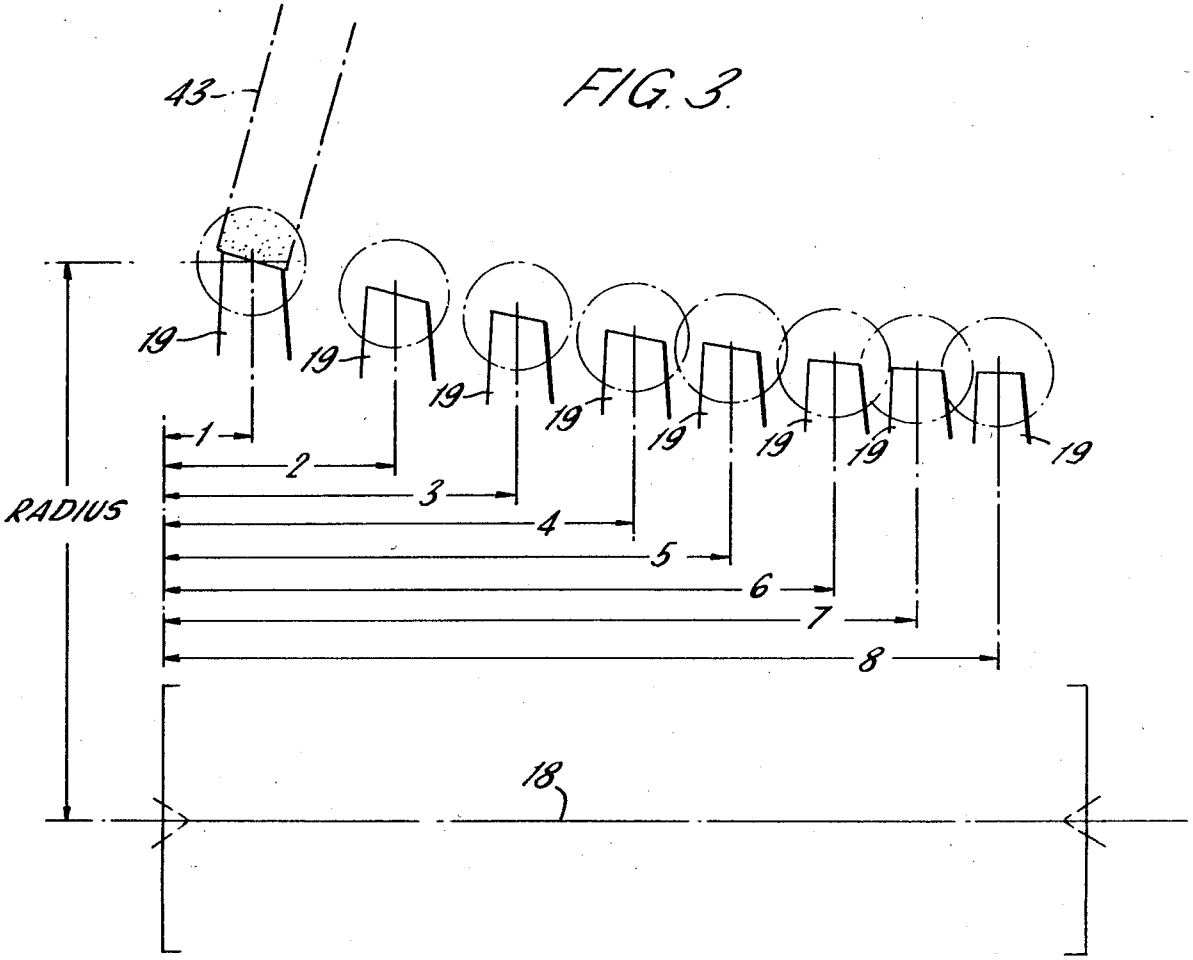
FIG. 3 is a diagrammatic view of the grinding wheel and rotor showing the different tip angles to which the blade tips are required to be ground.
Figure 5:
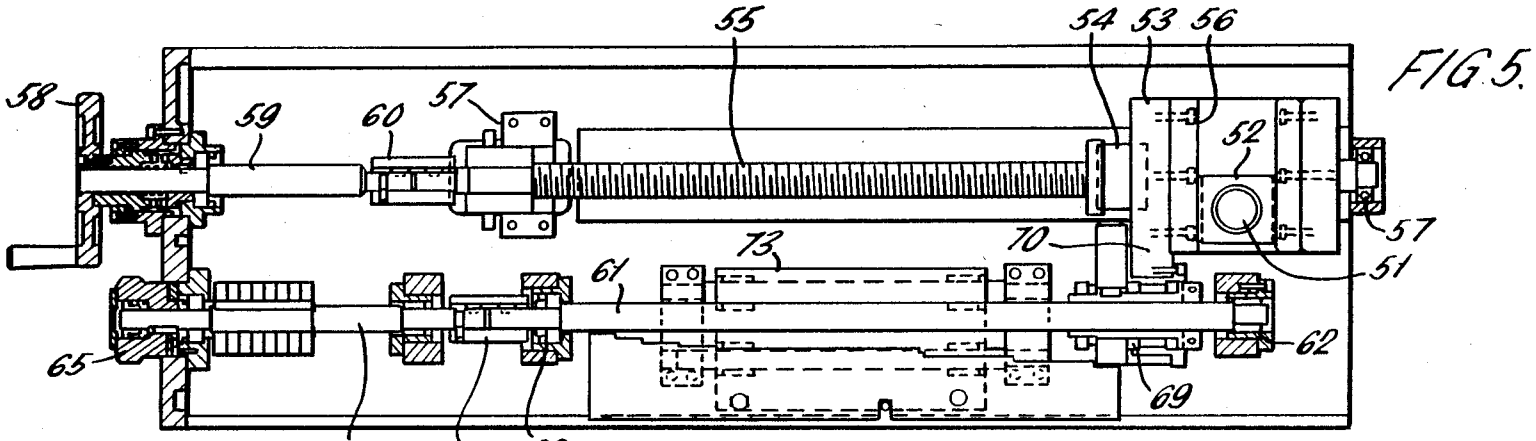
FIGS. 5–7 show further details of the adjusting mechanism.

As indicated earlier in the description with reference to FIG. 1 of the drawings, the ends 19*a* of the blade tips are angled differently from row to row of blades according to the contour of the casing within which the rotor is to operate. It is therefore necessary to angle the grinding wheel 43 to grind the blade tips to the correct angle with respect to the workpiece axis 18 as indicated in FIG. 3. Adjustment of the angle of operation of the grinding wheel 43 with respect to the workpiece axis 18 is effected by turning the grinding wheel carrier 27 about the axis 29. This adjustment is made for each row of blades 19 using the mechanism which will now be described with reference to FIGS. 4 and 5. As illustrated in FIGS. 4 and 5, the grinding wheel carrier 27 swings about the pivot axis 29 over the surface of the slide 21. At the end of the grinding wheel carrier remote from the pivot axis 29 there is a laterally projecting arm 50 having a pin 51 projecting downwardly from the end thereof and engaging in a bore in a slide block 52 as best seen in FIG. 5. A cross-head 53 is mounted by means of a ball nut 54 on a lead screw 55 and the cross-head 53 has a cross-block 56 in which the block 52 is slideably engaged. The lead screw 55 is rotatably supported in bearing mountings 57 and is turned by a handle wheel 58 through a drive shaft 59 and connector 60. By turning the hand wheel 58, the pin 51 is moved along the lead screw 55 thus turning the grinding wheel carrier 27 through the arm 50 about the pivot axis 29 to adjust the angle of cut of the grinding wheel with respect to the workpiece axis 18 as described earlier.

Parallel to the lead screw 55 there is mounted a further shaft 61 supported in bearings 62 and to which an input shaft 63 is coupled by a sleeve 64. The input shaft has an actuating knob 65 and carries a number of strikers 66 for selectively actuating a bank of micro-switches 67 according to the rotary position set by the selector knob 65. The shaft 61 carries a spider 68 of irregular length legs formed on a hub 69. An arm 70 connects the cross-head 53 to the hub so that the hub moves with the cross-head as the cross-head moves along the lead screw 55.

An elongate control member 71 is mounted adjacent the path of the spider 68 along the shaft 61 and is formed with spaced steps 72 along one edge thereof for engagement by respective legs of the spider 68. The steps define the positions to which the grinding wheel carrier 27 and therefore the grinding wheel itself can be turned about the axis 29. In the position shown in FIG. 4, the first longest leg of the spider 68 is shown engaging a first step 72 on the control member 71. When the grinding operation for that position of the grinding wheel carrier 27 has been completed, the actuating knob 65 is turned to disengage the first spider leg from the first shoulder 72 and to bring the second, shorter, spider leg into register with the control member 71. The length of the second leg is such that the spider can now move past the first step 72 of the control member but will be intercepted and stopped by the second step 72. The hand wheel 58 is then turned to rotate the grinding wheel carrier 27 as described previously and as the carrier turns, the spider 68 is drawn by the arm 70 until the second leg of the spider engages the second step 72.

Figure 6:
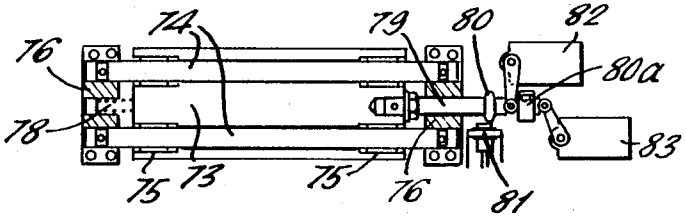
Figure 7:
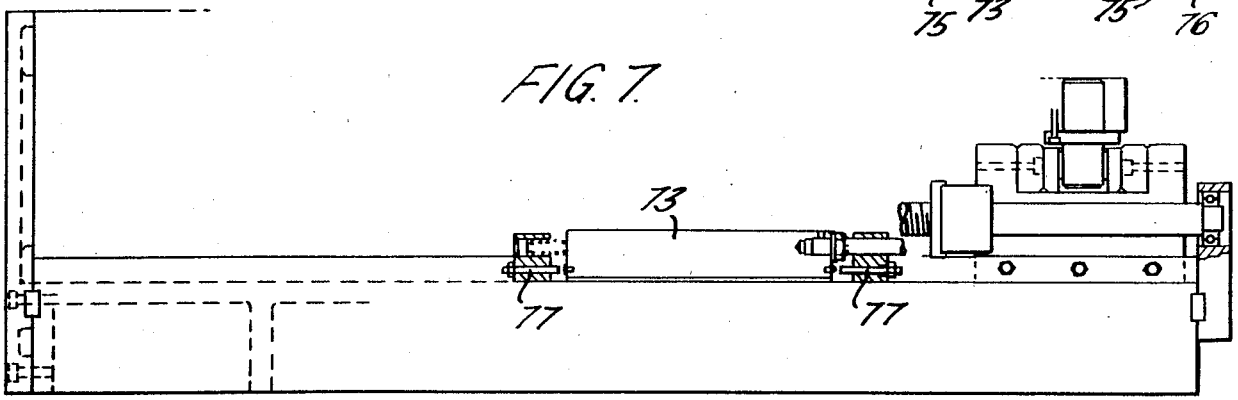

The control member 71 is mounted for limited longitudinal floating movement on a base member 73 which is best seen in FIG. 6. Base member 73 is mounted on a pair of parallel guide rods 74 by means of bearings 75. The parallel guide rods 74 are secured at their ends in fixed mounting 76. The movement of the base member 73 along the guide rods is limited by fixed stops 77 best seen in FIG. 7. The base member 73 is biassed in a dirrection towards the spider 68 by means of a compression spring 78 mounted between one mounting 76 and the adjacent end of the base member 73. The other end of the base member 73 has a projecting probe 79 which extends through the adjacent mounting 76 and is formed with two spaced collars **80,80*a* adjacent the end of the probe. The proximity switch 81 is located in the path of the collar 80 to give a signal to a control system for the grinding machine to indicate when the collar has been displaced into register with the probe by displacement of the control member 71 by the spider 68. The steps 72 on the control member 71 are positioned such that when the proximity switch 81 is triggered by the collar 80 by movement of the control member 71 in response to engagement of the spider 68 with a step 72 on the control member, the grinding wheel carrier 27 is in the required rotational position dictated by that step 72 on the control member. The other collar 80*a* is engaged on either side by operating members of limit switches 82, 83 which are set up to give a signal when the probe 79 and therefore the control member 71 has not yet reached its position for adjustment or has moved beyond the required position of adjustment as dictated by the proximity switch 81**.

The proximity switch 81, limit switches 82, 83 and switches 67 controlled by the selector knob 66 are all connected into a pre-programmed micro-processor which has appropriate indicators for showing the machine operator when the grinding wheel carrier is in its correct position, has not yet reached its correct position, or is beyond its correct position so that the hand wheel 58 can be adjusted appropriately.

As indicated earlier in the description, the turbine or compressor rotor to be ground is supported between centers 14 and 17 is traversed along the slideway 11 to present the rows of blades 19 one after the other in succession to the grinding wheel. The drive motor for controlling the lead screw 9 which moves the slide 12 along the slideway is controlled by a number of cams 84 spaced along and also vertically on the slide 12 for operating a stack of limit switches 85. The limit switches control, through the micro-processor referred to earlier a solenoid operated plunger 86, the solenoid being indicated at 87 mounted on the slideway to engage in a plurality of notches 88 spaced apart along the slide to determine the positions of adjustment of the slide along the slideway. The mouths of each notch 88 have stepped corners indicated at 89 and if the plunger 86 engages on a step as opposed to going fully home into a notch when it is fired by its solenoid, this is detected and a warning light is operated on the indicator system through the micro-processor. The operator can then manually operate the motor for the slide to move the slide forwardly sufficient to allow the plunger to go home fully. Once the plunger goes home fully, a signal is given from the plunger control to the micro-processor and an indicating light is illuminated accordingly.

In addition to the various proximity and limit switches referred to above, there are further switches throughout the apparatus so that the full operation of the machine is interlocked. Thus when a switch is pressed to cause the slide 12 to move to the next position to bring the next set of blades to the working position, the grinding wheel cannot be traversed forwardly to carry out the grinding operation until the micro-processor control system has detected that the slide 12 has moved to the correct position and that the correct new grinding wheel angle has been selected by the selector knob 65 and the grinding wheel carrier has been adjusted to the correct position by the hand wheel 58. The movement of the grinding wheel itself along its slideway 22 is controlled automatically by the micro-processor. Between grinding operations the slide 21 is located in a retracted position. When the slide 12 has been moved to a position and the grinding wheel carrier 21 adjusted to the required new angle, the operator operates a control to initiate the grinding cycle. The slide 21 is traversed rapidly along the slideway 22 to bring the grinding wheel near to the workpiece and then the motor of the lead screw 23 automatically reduces speed to move the grinding wheel forward slowly at the required feed speed for operating on the workpiece. When the grinding wheel is required to be dressed, the operator initiates the dressing sequence. This causes the dresser unit 49 to advance by a pre-set increment and, after the dressing operation has been completed, slide 42 is automatically advanced by its drive motor operated by the micro-processor control system to restore the grinding wheel to the operative position with the axis 29 lying tangentially to the new periphery of the grinding wheel as indicated in FIG. 2. The operator then actuates the motor for the slide 21 to drive the grinding wheel forwardly to continue the grinding operation. In some instances, it is necessary to dress the grinding wheel several times during the grinding of one row of turbine blades according to the material of the blades.

Figure 9:
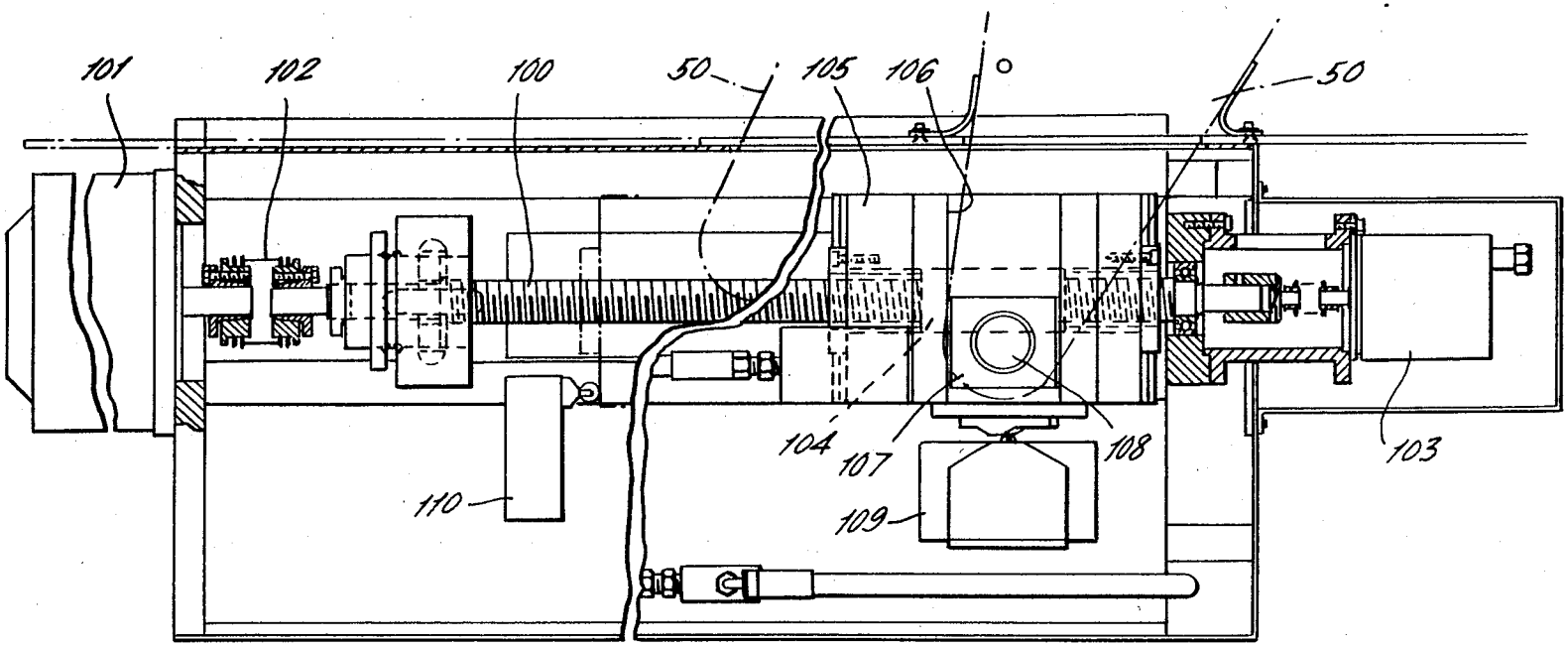
FIG. 9 is a similar view to FIG. 4 showing an alternative mechanism for adjusting the angle of the grinding head.

Reference is now made to FIG. 9 of the drawings which shows an alternative means for adjusting the wheel-head angle to that illustrated in FIGS. 4 and 5. Like parts have been allotted the same reference numeral. In the arrangement shown in FIG. 9, a precision recirculating ball-screw 100 is driven by D.C. servo-motor 101 connected by a driving connection 102 to one end of the ball-screw. A resolver 103 is connected to the other end of the ball-screw and provides positional feed-back to a N.C. (Numerical Control) or C.N.C. (Computerised Numeric Control) unit. The ball screw carries a nut 104 to which a block 105 is connected having a slideway 106 extending transversely of the ball screw in which a slide 107 is mounted carrying a trunnion 108 to which the projecting arm connected to the grinding wheel carrier 27 is connected as described above. The slide allows the trunnion to follow an arc of radius as the nut and block traverse along the screw to the position corresponding to the angles to be ground. Movement of the block 105 along the ball screw is limited by a datum switch 109 at one end of the travel and a limit switch 110 at the other end.

In some cases the control is programmed as a linear dimension and in other cases the C.N.C. calculates the position and displays the angle in degrees and minutes of arc.

An alternative system uses a stepper motor in place of the servo-motor with an otherwise similar mechanism.

I claim:

1. A machine tool, comprising:

workpiece support means for supporting a workpiece to rotate about a fixed first axis for an operation to be carried out on a peripheral part of said workpiece at a work station adjacent said workpiece;

slide means for supporting said workpiece support means for movement of said workpiece in the direction of said fixed first axis to present different locations along said workpiece for operation thereon at said work station;

a rotary tool having a peripheral cutting face;

a feed slide for said tool;

means to feed said feed slide towards and away from said fixed first axis for said tool to act on said workpiece;

a tool carrier;

means to mount said tool on said tool carrier for rotation of said peripheral cutting face;

means to mount said tool carrier on said feed slide for rotational adjustment about a second axis lying tangential to a circle defining the periphery of said peripheral cutting face of said tool;

means to mount said tool for linear adjustment on said tool carrier towards and away from said second axis for bringing said peripheral cutting face of said tool to a point tangential to said second axis at which said point the peripheral cutting face of said tool engages said workpiece such that said rotational adjustment of said tool about said second axis does not otherwise radially displace said peripheral cutting face of said tool at said point where said peripheral cutting face engages said workpiece;

mounting means on the machine tool coincidental with said second axis, a removable tool alignment means capable of being supported by said mounting means along said second axis prior to a cutting operation for cooperation with said linear adjustment means for thereby aligning the peripheral cutting face of said tool at said point to said second axis prior to the cutting operation; and means to turn said tool carrier about said second axis to any one of a number of defined positions of adjustment to provide a number of differing angles of operation of said tool on said workpiece such tht automatic control of said operation is facilitated.

2. A machine tool as claimed in claim 1 wherein said means to mount said tool for linear adjustment comprises a slideway and a slide each mounted on said tool carrier and each extending transversely to said fixed first axis and means to feed said slide mounted on said tool carrier comprising a drive means for moving said slide along said slideway.

3. A machine tool as claimed in claim 2 wherein said means to mount said tool carrier on said feed slide for rotational adjustment about said second axis comprise a rotary mounting disposed at an end portion of said feed slide adjacent said fixed first axis for rotating said tool carrier on said feed slide about said rotary mounting and about said second axis, and wherein said means to turn said tool carrier about said second axis comprises adjustment means disposed between said tool carrier and said feed slide for turning said tool carrier with respect to said feed slide about said second axis to any one of a plurality of defined positions to adjust said angles of operation of said tool.

4. A machine tool as claimed in claim 3 wherein said feed slide comprises a bearing surface portion upon which said tool carrier is seated for supporting said tool carrier such that said tool carrier is slidable over said bearing surface portion for adjustment of said angles of operation.

5. A machine tool as claimed in claim 3 wherein said adjustment means comprises a lead screw rotatably mounted on said feed slide and carrying a nut to which said tool carrier is connected.

6. A machine as claimed in claim 5 wherein said adjustment means further comprises a control member extending parallel to said lead screw and having a plurality of spaced apart stops provided along said control member and an adjustable cam mounted to move with said tool carrier and engagable with said plurality of spaced apart stops to determine said any one of said plurality of defined positions to which said tool carrier may be moved.

7. A machine tool as claimed in claim 6, further comprising:

a rotary shaft extending parallel to said lead screw and having said cam mounted thereon to turn with said rotary shaft and to slide along said rotary shaft;

connecting means provided between said nut and said cam for moving said cam with said nut along said rotary shaft as said nut moves along said lead screw; and means for rotating said rotary shaft for selecting a rotational position of said cam on said rotary shaft to engage said cam with a predetermined one of said plurality of spaced apart stops for setting an angle between said tool carrier and said workpiece.

8. A machine tool as claimed in claim 6 wherein said cam comprises a spider cam having a plurality of legs of different lengths each for engagement with a corresponding one of said plurality of spaced apart stops along said control member.

9. A machine tool as claimed in claim 6 wherein said control member comprises mounting means for permitting limited sliding movement of said control member with said cam upon engagement of said cam with one of said plurality of spaced apart stops;

spring means biased against said limiting sliding movement of said control member; and means for indicating registration of said control member with a datum position corresponding to one of said plurality of defined positions to which said tool carrier may be moved.

10. A machine tool as claimed in claim 9 wherein said means for indicating registration comprises a proximity switch actuated via said control member and wherein said machine tool further comprises means for indicating misalignment of said control member with said datum position.

11. A machine tool as claimed in claim 10 wherein said means for indicating misalignment comprises at least one limit switch operated via said control member.

12. A machine tool as claimed in claim 7 further comprising switch means operatively associated with said rotary shaft and operated in accordance with said rotational position of said cam for generating an input signal to a control system for controlling said operation.

13. A machine tool as claimed in claim 1 wherein said rotary tool comprises a grinding wheel.

14. A machine tool as claimed in claim 13 further comprising:

dressing means provided on said tool carrier for dressing said grinding wheel;

means for advancing said dressing means toward said grinding wheel for dressing said grinding wheel; and means for repositioning said grinding wheel such that said peripheral cutting face of said tool returns to said point tangent to said second axis.

15. A machine tool as claimed in claim 1 wherein said slide means comprises a workpiece slide having workpiece supports disposed thereon defining said fixed first axis, a workpiece slideway extending parallel to said fixed first axis, and means for moving said workpiece slide to a plurality of stations along said workpiece slideway to present said different locations along said workpiece to said rotary tool for operation thereon and wherein said means for supporting said workpiece further comprises means for rotating said workpiece about said fixed first axis.

16. A machine tool as claimed in claim 15 wherein said means for moving said workpiece slide to a plurality of stations along said workpiece slideway comprises a motor driven lead screw.

17. A machine tool as claimed in claim 15 further comprising:

stop means provided on said workpiece slideway and extending parallel to said fixed first axis for engaging said slide means;

locking means for locking said workpiece slide at each one of said plurality of stations; and means for detecting registration of said workpiece slide with each of said plurality of stations and for actuating said locking means.

18. A machine tool as claimed in claim 1 having a control system for controlling a number of functions of said machine tool and having means for detecting operation of each of said functions such that said control system carries out said functions in a predetermined sequence.

19. A machine tool as claimed in claim 5 further comprising a resolver controlled servo motor for driving said lead screw.

20. A machine tool as claimed in claim 5 further comprising a stepper motor for driving said lead screw.

21. The machine tool according to claim 1, wherein said mounting means for said alignment means is located on the tool carrier mounting means and defines an annular socket coincident with said second axis, said tool alignment means comprising an elongated setting bar extending coaxial to said second axis beyond said point tangential to said second axis.

22. The machine tool according to claim 21, wherein a dial gauge is provided on said setting bar at the point tangential to said second axis for engaging said peripheral cutting face, said gauge having zero indicating means indicating that said second axis intercepts said peripheral cutting face at said point tangential to said second axis, said rotary tool being adjustable by said linear adjustment means until said gauge reads zero.

23. A machine tool comprising:

workpiece support means for supporting a workpiece to rotate about a fixed first axis for an operation to be carried out on a peripheral part of said workpiece at a work station adjacent said workpiece;

first slide means for supporting said workpiece support means for movement of said workpiece in the direction os said fixed first axis to present different locations along said workpiece for operation thereon at said work station;

a rotary tool having a peripheral cutting face;

a tool carrier;

means to mount said tool on said tool carrier for rotation of said peripheral cutting face of said tool;

means to mount said tool carrier for rotational adjustment about a second axis lying tangentially to a circle centered on said fixed first axis, said circle defining a required machined radius of said workpiece at each of said different locations;

means to turn said tool carrier about said second axis to a plurality of different angles of operation of said tool on said workpiece such that automatic control of said operation is facilitated; and second slide means to move said tool carrier linearly towards and away from a position in which said second axis extends tangentially to said cutting face of said tool and to said circle; and mounting means on the machine tool coincident with said second axis, a removable tool alignment means capable of being supported by said mounting means along said second axis prior to a cutting operation for cooperation with said second slide means for thereby aligning the peripheral cutting face of said tool with said second axis prior to the cutting operation.

24. A machine tool as claimed in claim 23 wherein said second slide means comprises a feed slide for said tool and means to feed said feed slide towards and away from said fixed axis for said tool to act on said workpiece.

25. A machine tool as claimed in claim 23 wherein said second slide means comprises a slideway and a slide each extending transversely to said fixed first axis and means to feed said slide comprising a drive means for moving said slide along said slideway.

26. A machine tool as claimed in claim 25 wherein said means to mount said tool carrier for rotational adjustment about said second axis comprises a rotary mounting disposed adjacent said fixed first axis for rotating said tool carrier about said rotary mounting and about said second axis, and wherein said means to turn said tool carrier about said second axis comprises adjustment means for turning said tool carrier about said second axis to any one of said plurality of different angles of operation to adjust said angles of operation of said tool.

27. A machine tool as claimed in claim 26 further comprising a bearing surface portion upon which said tool carrier is seated for supporting said tool carrier such that said tool carrier is slidable over said bearing surface portion for adjustment of said different angles of operation.

28. A machine tool as claimed in claim 26 wherein said adjustment means comprise a lead screw operatively associated with said means to mount said tool carrier and carrying a nut to which said tool carrier is connected.

29. A machine as claimed in claim 28 wherein said adjustment means further comprises a control member extending parallel to said lead screw and having a plurality of spaced apart stops provided along said control member and an adjustable cam mounted to move with said tool carrier and engageable with said plurality of spaced apart stops to determine said any one of said plurality of different angles of operation of which said tool carrier may be moved.

30. A machine tool as claimed in claim 29, further comprising:

a rotary shaft extending parallel to said lead screw and having said cam mounted thereon to turn with said rotary shaft and to slide along said rotary shaft;

connecting means provided between said nut and said cam for moving said cam with said nut along said rotary shaft as said nut moves along said lead screw; and means for rotating said rotary shaft for selecting a rotational position of said cam on said rotary shaft to engage said cam with a predetermined one of said plurality of spaced apart stops for setting an angle between said tool carrier and said workpieice.

31. A machine tool as claimed in claim 29 wherein said cam comprises a spider cam having a plurality of legs of different lengths each for engagement with a corresponding one of said plurality of spaced apart stops along said control member.

32. A machine tool as claimed in claim 29 wherein said control member comprises mounting means for permitting limited sliding movement of said control member with said cam upon engagement of said cam with one of said plurality of spaced apart stops;

spring means biased against said limited sliding movement of said control member; and means for indicating registration of said control member with a datum position corresponding to one of said plurality of different angles of operation to which said tool carrier may be moved.

33. A machine tool as claimed in claim 32 wherein said means for indicating registration comprises a proximity switch actuated via said control member and wherein said machine tool further comprises means for indicating misalignment of said control member with said datum position.

34. A machine tool as claimed in claim 33 wherein said means for indicating misalignment comprises at least one limit switch operated via said control member.

35. A machine tool as claimed in claim 30 further comprising switch means operatively associated with said rotary shaft and operated in accordance with said rotational position of said cam for generating an input signal to a control system for controlling said operation.

36. A machine tool as claimed in claim 24 wherein said rotary tool comprises a grinding wheel.

37. A machine tool as claimed in claim 36 further comprising:

dressing means provided on said tool carrier for dressing said grinding wheel; and means for advancing said dressing means toward said grinding wheel for dressing said grinding wheel.

38. A machine tool as claimed in claim 23 wherein said first slide means comprises a workpiece slide having workpiece supports disposed thereon defining said fixed first axis, a workpiece slideway extending parallel to said fixed first axis, and means for moving said workpiece slide to a plurality of stations along said workpiece to said rotary tool for operation thereon and wherein said means for supporting said workpiece further comprises means for rotating said workpiece about said fixed first axis.

39. A machine tool as claimed in claim 38 wherein said means for moving said workpiece slide to a plurality of stations along said workpiece slideway compreses a motor driven lead screw.

40. A machine tool as claimed in claim 38 further comprising:

stop means provided on said workpiece slideway and extending parallel to said fixed first axis for engaging said slide means;

locking means for locking said workpiece slide at each one of said plurality of stations; and means for detecting registration of said workpiece slide with each of said plurality of stations and for actuating said locking means.

41. A machine tool as claimed in claim 23 having a control system for controlling a number of functions of said machine tool and having means for detecting operation of each of said functions such that said control system carries out said functions in a predetermined sequence.

42. A machine tool as claimed in claim 28 further comprising a resolver controlled servo motor for driving said lead screw.

43. A machine tool as claimed in claim 28 further comprising a stepper motor for driving said lead screw.

44. The machine tool according to claim 23, wherein said mounting means for said alignment means is located on the tool carrier mounting means and defines an annular socket coincident with said second axis, said tool alignment means comprising an elongated setting bar extending coaxial to said second axis beyond said point tangential to said second axis.

45. The machine tool according to claim 44 wherein a dial guage is provided on said setting bar at the point tangential to said second axis for engaging said peripheral cutting face, said gauge having a zero indicating means indicating that said second axis intercepts said peripheral cutting face at said point tangential to said second axis, said rotary tool being adjustable by said second slide means until said gauge reads zero.

* * * * *